United States Patent [19]

Theurer

[11] 4,430,945

[45] Feb. 14, 1984

[54] MOBILE TAMPING, LEVELING AND LINING MACHINE

[75] Inventor: Josef Theurer, Vienna, Austria

[73] Assignee: Franz Plasser Bahnbaumaschinen-Industriegesellschaft m.b.H., Vienna, Austria

[21] Appl. No.: 290,193

[22] Filed: Aug. 5, 1981

[30] Foreign Application Priority Data

Sep. 4, 1980 [AT] Austria ..... 4462/80

[51] Int. Cl.[3] ..... E01B 29/04

[52] U.S. Cl. ..... 104/7 B; 104/7 R

[58] Field of Search ..... 104/7 R, 7 A, 7 B, 8, 104/2

[56] References Cited

U.S. PATENT DOCUMENTS

| | | | |
|---|---|---|---|
| 3,230,895 | 1/1966 | Stewart . | |
| 3,381,625 | 5/1968 | Plasser et al. . | |
| 3,381,626 | 5/1968 | Fagan et al. | 104/7 B |
| 3,910,195 | 10/1975 | Theurer . | |

FOREIGN PATENT DOCUMENTS

| | | | |
|---|---|---|---|
| 570863 | 2/1933 | Fed. Rep. of Germany | 104/8 |
| 570864 | 2/1933 | Fed. Rep. of Germany | 104/8 |
| 243244 | 11/1925 | United Kingdom . | |
| 1350436 | 4/1974 | United Kingdom . | |

*Primary Examiner*—Randolph Reese
*Assistant Examiner*—Gregory A. Beehner
*Attorney, Agent, or Firm*—Kurt Kelman

[57] ABSTRACT

A mobile track tamping, leveling and lining machine comprises a vertically and laterally movable lifting and lining tool carrier for correcting the track position. Two track rail engaging rollers or each track rail are mounted on the carrier and the rollers are arranged on opposite sides of each rail and have a circumferential configuration conforming to the side faces and undersides of the head of the rail on opposite sides thereof. A pivoting arm is connected to each roller and is pivotal on the tool carrier about a vertical axis for pivoting the rollers in a plane substantially parallel to the track. Drives are connected to each pivoting arm for driving the rollers into force-transmitting engagement with the conforming side face and underside of a respective track rail.

5 Claims, 6 Drawing Figures

MOBILE TAMPING, LEVELING AND LINING MACHINE

The present invention relates to a mobile tamping, leveling and lining machine for correcting the position of a track and comprising a tool carrier mounted on the machine for movement along, and on, the track rails, lifting and lining drive means for vertically and laterally moving the tool carrier, and track engaging tool means mounted on the carrier and comprising two track rail engaging rollers for each track rail.

U.S. Pat. No. 3,230,895, dated Jan. 25, 1966, discloses a railroad working machine equipped with a transversely extending tool carrier running on wheels on the track rails and being vertically movably connected to the main frame of the machine. Telescoping slides project from the ends of the tool carrier beyond the respective track rails and carry jacks capable of engaging the ballast in the track shoulders. Two hooks associated with each rail are mounted on the underside of the tool carrier and are pivotal about axes extending parallel to the rails for pivoting into rail engaging position. Each pair of hooks is connected by a hydraulic drive for pivoting the hooks into and out of the rail engaging position. The pivoting radius of the hooks is small and, therefore, causes favorable rail engaging conditions and the arrangement is ill adapted to different rail head dimensions. In addition, the hooks must be disengaged from the rails after each track position correction operation to enable the machine to advance to the next working position where the hooks must be pivoted again for engagement with the rails. Another disadvantage arises when a tack section must be raised a substantial distance because only the jacks are used for lifting and the nature of the jack supporting track bed shoulders produces a labile support. Finally, the arrangement may be used only for lifting the track.

U.S. Pat. No. 3,381,625, dated May 7, 1968, discloses a mobile track tamping and leveling machine equipped with a track lifting arrangement comprising a pair of rail clamping rollers associated with each rail. The rollers are mounted on a tool carrier vertically movable on a vertical guide rod mounted on the front of the machine frame. To reinforce the lifting force, if needed, additional lifting cylinders are mounted at the outer ends of the tool carrier for engagement with the ballast of the track bed shoulders. All the clamping rollers remain in constant engagement with the track rails so that the track may be raised at any desired point, even in the range of fishplates interconnecting abutting ends of adjacent rail sections. With the use of the lifting cylinders, the track lifting stroke may be substantial.

U.S. Pat. No. 3,910,195, dated Oct. 7, 1975, discloses a high-efficiency track tamping, leveling and lining machine equipped with a track lifting and leveling unit carrying two pairs of flanged rail-gripping rollers for each rail. Such vertically and laterally movable units have been found very effective in large high-efficiency machines of this general type.

British Pat. No. 1,350,436, published Apr. 18, 1974, deals with the lifting of railway track during such track maintenance work as ballast cleaning, for example, wherein the lifting stroke is often considerable. The disclosed arrangement is designed to reduce the heavy stresses to which the rails are subjected during lifting at rail joints, for example, where the rails must be engaged at different points. For this purpose, the patent proposes the arrangement of two pairs of rail engaging rollers at a distance from each other at each rail, one of the rollers of each pair subtending the rail head at the inside of the rail and the opposite roller of each pair having a frustoconical circumference engaging the upper edge of the rail head at the outside of the rail so that the rail head is held between the pair of rollers. Arms pivotal about a vertical axis carry the rollers for movement into and out of engagement with the inside and outside of each rail. The pivotal arms are vertically movable. When one of the pairs of rail engaging rollers approaches the range of a rail joint where a fishplate connects abutting rail sections or a like structural element constituting an obstacle which interferes with a secure engagement of one pair of the rollers with the rail, the other pair of rail engaging rollers spaced therefrom may be used to lift the rail sufficiently to maintain the rail at the lifted level in the range of the one roller pair. Thus, sudden load impacts will be avoided when one of the pairs of rollers is pivoted out of engagement with the rail.

It is the primary object of this invention to provide a mobile tamping, leveling and lining machine of medium or relatively light weight and simple structure with structurally simple track lifting and lining means functionally equivalent to the track leveling and lining units in use on high-efficiency, heavy track tamping, leveling and lining machines.

The above and other objects are accomplished according to the invention in a mobile track tamping, leveling and lining machine of the first-described type with track engaging rollers arranged on opposite sides of the rail and having a circumferential configuration conforming to the side faces and undersides of the head of the rail on the opposide sides thereof. A pivoting arm is connected to each track rail engaging roller and is pivotal on the tool carrier about a vertical axis for pivoting the roller in a plane substantially parallel to the track, and drive means is connected to each pivoting arm for driving the rollers into force-transmitting engagement with the conforming side face and underside of a respective track rail.

This arrangement provides a very secure gripping of the rail in every pivotal position of the rollers in engagement with the opposite sides of the associated rail, the conforming configuration of the rollers assuring a close and tolerance-free rail gripping engagement providing effective leveling and lining force transmission to the gripped rail. This makes it possible to use relatively large track position correcting forces, the conditions of rail engagement remaining substantially unchanged since the paths of the pivoting rail engaging rollers extend in a plane parallel to the track and perpendicular to the plane defined by the rail web. Therefore, the same positions relative to the rail are assured for all pivotal positions of the rollers. These constant rail gripping conditions provide a secure and force-transmitting connection between the pairs of rollers and the rail engaged therebetween so that even relatively large lifting and/or lining forces will be securely transmitted to the track rails. Since differences in the dimensions of the rail head, such as the width thereof, have no influence on the rail engagement conditions, the arrangement may be used effectively on tracks with varying rail profiles along succeeding track sections. Furthermore, this type of equipment may not only be used alone for track leveling and lining on track tampers but it may be combined with a variety of track lifting and leveling tools, such as rail engaging hooks, flanged rail engaging rollers and the like, depending on specific machine structures and working conditions.

The above and other objects, advantages and features of the present invention will become more apparent from the following detailed description of certain now preferred embodiments thereof, taken in conjunction with the accompanying drawing wherein.

Figure 1:
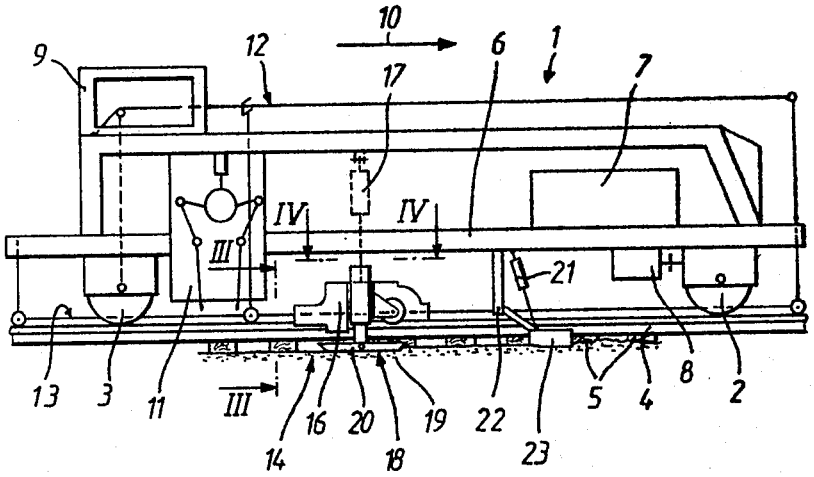
FIG. 1 is a simplified and schematic side view of a track tamping leveling and lining machine equipped with track lifting and lining means according to this invention.

Referring now to the drawing and first to FIG. 1, generally conventional mobile track tamping, leveling and lining machine 1 for correcting the position of a track is shown to comprise frame 6 supported on front undercarriage 2 and rear undercarriage 3 for mobility on a track comprised of rails 4 fastened to ties 5. Power plant 7 is mounted on machine frame 6 and transmission 8 connects the power plant to a drive for the wheels of the front undercarriage. Operator's cab 9 is mounted on the rear of the machine frame.

During track correction, machine 1 is moved in the direction of arrow 10 and ballast tamping head 11 is mounted on machine frame 6 adjacent rear undercarriage 3 and forwardly thereof in relation to the operating direction indicated by arrow 10. The machine frame also carries a generally conventional leveling and lining reference system 12, 13. Since ballast tamping means and track position reference systems are well known and their particular structure is of no significance to the invention, they are not described in detail.

Figure 4:
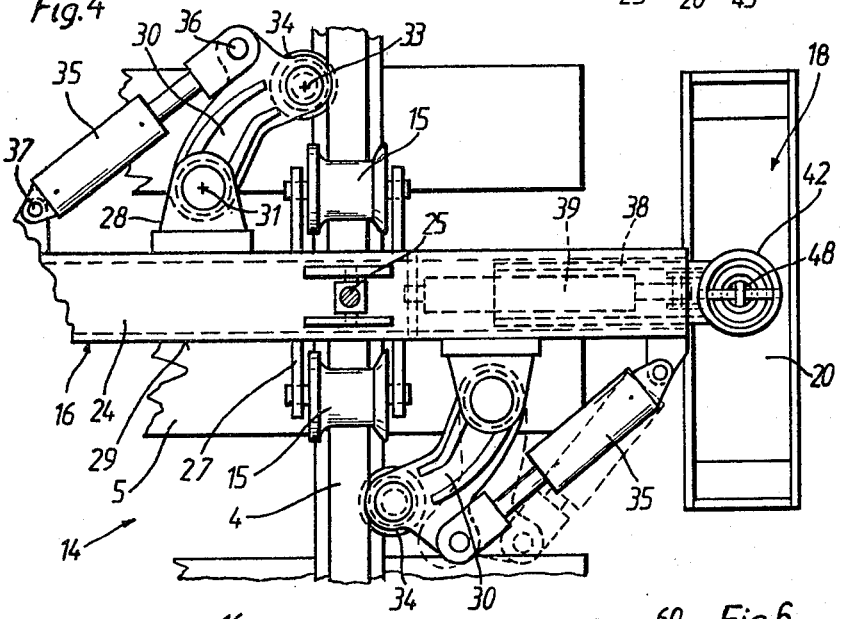
FIG. 4 is a top view along line IV—IV of FIG. 1.

Mobile track tamping, leveling and lining machine 1 is equipped with track lifting and lining unit 14 mounted forwardly of tamping head 11 in the operating direction. This unit comprises tool carrier 16 mounted on machine 1 for movement along, and on, track rails 4 by means of double-flanged wheels 15, 15 whose flanges engage the rail head of rail 4 therebetween so that the wheels may serve as lining rollers holding the rail during lateral movement thereof. The illustrated lifting drive means for vertically moving tool carrier 16 comprises power drive 17 shown as hydraulic cylinder linking the tool carrier to machine frame 6. As best shown in FIG. 4, laterally as well as vertically adjustable support jacks 18 are mounted at the outer ends of tool carrier 16 and comprise shoe 20 engageable with ballast 19 in the track bed shoulders.

Ballast plowing plates 23 are arranged at respective sides of the machine between lifting and lining unit 14 and front undercarriage 2 for engagement with the ballast adjacent the ends of ties 5 in the track bed shoulders. The ballast plowing plate is linked to a bracket affixed to machine frame 6 by means of pivot 22 extending transversely to the track and parallel thereto and may be pivoted thereabout by hydraulic drive 21. This arrangement enables the ballast in the track bed shoulders to be planed to provide a good support surface for suceeding jack shoe 20.

Figure 2:
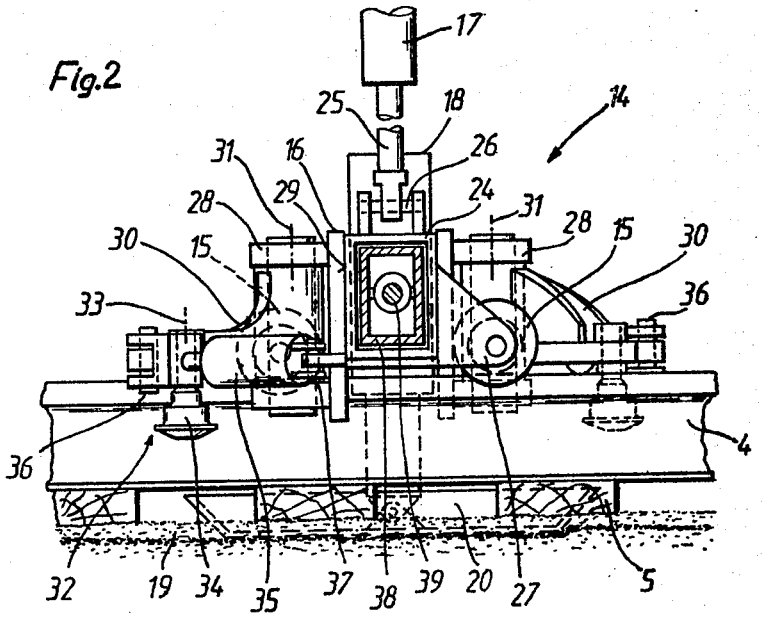
FIG. 2 is an enlarged side view, partly in section, of the track lifting and lining unit of the machine of FIG. 1.

As best shown in FIG. 2, tool carrier 16 is comprised essentially of cross beam 24 extending transversely to the track over rails 4, 4 and having a rectangular cross section. Piston rods 25 of hydraulic drives 17 are linked to axles 26 extending in the direction of rails 4 and affixed to brackets on the upper side of the cross beam. Pairs of bearing plates 27 are affixed to the cross beam and the bearing plates are transversely spaced from each other to hold double-flanged wheels 15 therebetween (see also FIG. 3).

Figure 3:
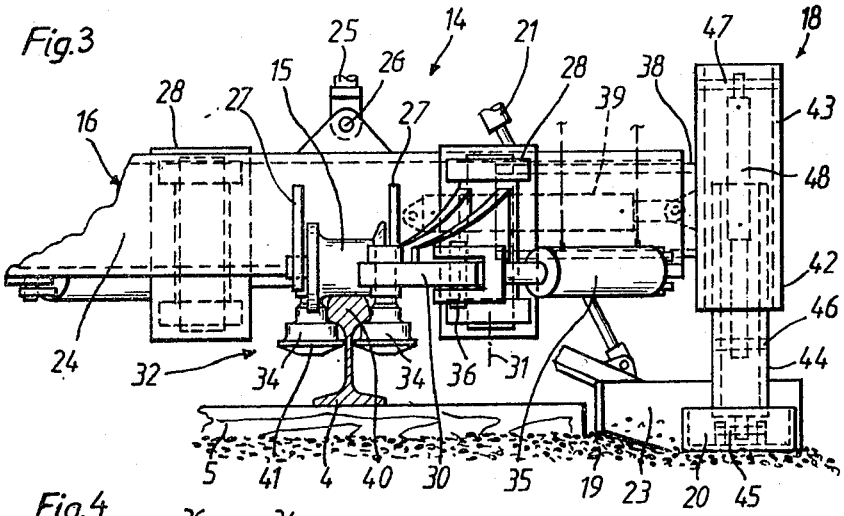
FIG. 3 is an end view of this unit along line III—III of FIG. 1.

The track engaging tool means 32 mounted on tool carrier 16 comprises two track rail engaging rollers 34, 34 for each track rail 4. The rollers are arranged on opposite sides of the rail and, as shown in FIG. 3, have a circumferential configuration or profile conforming to the side faces and undersides of head 40 of the rail on the opposite sides thereof. Pivoting arm 30 is connected to each track engaging roller 34 and is pivotal on tool carrier 16 about vertical axis 31 for pivoting the rollers in a plane substantially parallel to the track. In the illustrated embodiment, two brackets 28, 28 per rail 4 are affixed to cross beam 24 and project from respective lateral faces 29, 29 of the cross beam in opposite directions, being equidistantly spaced to the left and to the right of associated rail 4. A pivot extending in vertical axis 31 mounts each arm 30 on respective bracket 28 and respective track rail engaging roller 34 is arranged at the free end of each pivotal arm 30.

In the illustrated embodiment, each roller 34 is a rotary body having an eccentric axis of rotation 33 substantially parallel to vertical pivoting axis 31, the distance between the axes corresponding at least to half a width of rail head 40. This provides a particularly space-saving and simple structural arrangement. The roller configuration conforming to the rail head configuration enables the rollers to remain in constant rolling engagement with the rail without changing the relative position of the roller to the rail while the track is lined or leveled in a continuous or a step-wise operation.

Drive means is connected to each pivoting arm 30 for driving rollers 34 into force-transmitting engagement with the conforming side face and underside of respective track rail 4. The illustrated drive means comprises hydraulic jack 35 whose respective ends are linked to cross beam 24 and arm 30 by bolts 37 and 36.

Figure 5:
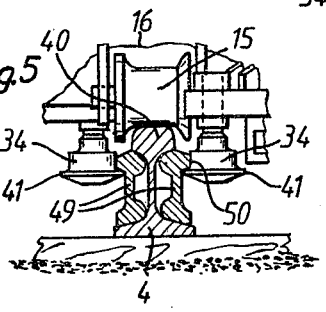
FIG. 5 is a smaller and partial view of the unit similar to that of FIG. 3 but in a different operating position of the rail engaging rollers.

As illustrated in FIGS. 3 and 5, each track rail engaging roller 34 has radially projecting collar 41 at a lower portion of the roller for engaging a structural element of the rail arranged in the range of the vertical rail web. In the rail gripping position of track engaging tool means 32 shown in FIG. 3, configurated rollers 34 are in full and tolerance-free engagement with the opposite side faces and undersides of rail head 40 under the closing pressure of hydraulic jacks 35. Together with double-flanged wheels 15, rollers 34 thus constitute a laterally and vertically rigid and force-transmitting connection between tool carrier 16 and the two rails 4 of the track.

FIG. 4 shows rollers 34 in their rail gripping position in full lines. In the lower right-hand portion of the figure, one of the rollers 34 is shown in the rest position in broken lines. In the rest position of track engaging tool means 32, rollers 34 are pivoted away from rail 4 and tool carrier 16 may be lowered by drive 17 at the beginning of the track correction operation so that the tool carrier wheels 15 come to rest on rails 4. At the end of the operation, rollers 34 are pivoted outwardly again to enable the tool carrier to be lifted off the rails during movement of the machine to the next operating site.

In FIG. 5, the gripping position of rollers 34 is shown during track correction in the range of a rail joint where a direct engagement of the rollers with rail head 40 is made impossible by fishplates 49, 49 which interconnect the abutting ends of the rail sections at the joint. In this case, radially projecting collar 41 of roller 34 subtends upper edge 50 of fishplate 49, which makes it possible to obbtain an equally secure gripping connection for the track rail engaging rollers where such a stuctural element is arranged in the range of the vertical rail web.

Tool carrier 16 is a cross beam extending substantially centrally between the two rollers 34, 34 associated with each track rail 4. Each pivotal arm 30 is pivotal about a respective vertical axis 31, the pivotal arms and track rail engaging rollers 34, 34 associated with one of the track rails being arranged mirror-symmetrically with respect to the arms and rollers associated with the other track rail. This arrangement is particularly simple and well adapted to fit the structure and space availability of track position correction machines so as to make the track leveling and lining equipment well adapted to all sorts of operating conditions.

FIG. 3 also illustrates the structure of shoulder support jacks 18, the side view of FIG. 2 showing only telescoping guide part 38 of the jack facing the viewer so as not to obscure other parts of the structure. As indicated in the section of FIG. 2, guide part 38 is a rectangular tube slidingly fitting into rectangular cross beam 24 and being telescopingly adjustable relative to the beam by hydraulic drive 39 housed in the cross beam to enable jack 18 to be moved into and out of the ends of cross beam 24 for placing the jack at selected portions of the track shoulders. Jack 18 comprises telescoping support 42 rigidly affixed to telescoping guide part 38. Support 42 has cylindrical casing 43 slidingly receiving and guiding another tubular guide part 44. Jack shoe 20 is mounted on the lower end of guide part 44 for pivoting about fulcrum 45 extending transversely to the track. Hydraulic drive 48 extends axially in tubular guide part 44 and respective ends of drive 48 are linked to casing 43 ad guide part 44, respectively, by axles 46 and 47 also extending transversely to the track.

Figure 6:
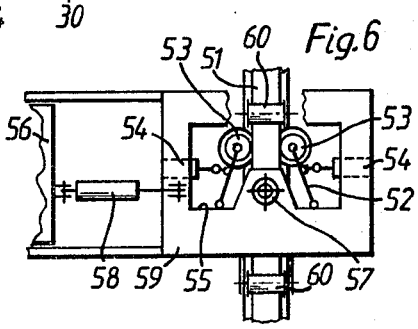
FIG. 6 shows schematically a partial top view of another embodiment.

FIG. 6 schematically illustrates another embodiment of the track engaging tool means of the present invention. This figure also shows the lining drive means for laterally moving the tool carrier, which has been provided in the above-described embodiment by hydraulic drives 39.

In this embodiment, tool carrier 59 associated with each rail 51 is linked to machine frame 56 by lifting drive 57 and lining drive 58 for vertically and laterally moving the tool carrier. The track engaging tool means comprises two track rail engaging rollers 53, 53 profiled in the same manner as rollers 34 and pivoting arms 52, 52 are connected to rollers 53. The pivoting arms are pivoted to the same lateral face 55 of tool carrier 59, the pivoting arms and rollers being arranged symmetrically with respect to the associated rail. Pivoting drives 54, 54 link the pivoting arms to the tool carrier. This arrangement provides a pincer-like grip on opposite points of rail 51, with a complete equilibrium between the lateral forces to which pivoting drives 54 subject rail 51. Contrary to the first-described embodiment, the lifting and lining forces are transmitted to the track rails exclusively from machine frame 56 through rollers 53 and double-flanged lining wheels 60.

The operation of the machine will now be described in detail in connection with the embodiment of FIGS. 1 to 5:

When tack tamping, leveling and linine machine 1 arrives at an operating site, the two shoulder ballast plowing plates 23 are lowered onto the shoulders of the track bed by hydraulic drives 21. The machine is then advanced in the operating direction indicated by arrow 10 a sufficient distance, such as several meters, to enable the ballast plowing plates to prepare a smooth support surface of jack shoes 20. Tool carrier 16 is then lowered by hydraulic drives 17 until double-flanged wheels 15 rest on rails 4 so that the tool carrier runs on the rail tracks. Hydraulic drives 35 are then operated to pivot track rail engaging rollers 34 into gripping engagement with the track rails, pivoting arms 30 moving in a plane extending parallel to the track about vertical axes 31. Hydraulic drives 35 are maintained under pressure to maintain rollers 34 in force-transmitting and tolerance-free engagement with the rails. Hydraulic drives 39 are now operated to move telescoping guide parts 38 carrying jacks 18 outwardly to position jack shoes 20 at a desired distance from the ends of track ties 5 for engagement with the smoothed ballast in the track bed shoulders. Hydraulic drive 48 is then operated to lower the jack shoes onto ballast 19. At this point, the machine is operative to correct the position of the track in relation to reference systems 12, 13. For leveling the track in relation to reference system 12, lifting drives 17 and 48 are operated until each rail has reached the desired level. For lining the track in relation to reference system 13, hydraulic drives 39 are operated to cause tool carrier 16 constituted by cross beam 24 to be moved laterally with respect to jacks 18 until the track has reached the desired alignment, the track rails being held during the transverse movement by double-flanged wheels 15 and rollers 34. If drives 39 are constituted by double-acting jacks both lining drives may be operated simultaneously, with the hydraulic pressure applied to the drives in opposite directions.

Advantageously, machine 1 is stopped at each tie 5 for leveling and/or lining the track at this tie and then tamping the ballast under the tie for fixing the track in the corrected position. However, if desired, track correction may be effected at any desired track point.

At the end of the track position correction operation, jacks 18 are retracted vertically and laterally by operation of drives 48 and 39, whereupon rollers 34 are disengaged from rails 4 to enable tool carrier 16 to be raised off the track. Ballast plowing plates 23 are then also raised to put the machine in condition for movement to another operating site.

The embodiment of FIG. 6 operates equivalently in a manner that will be obvious to those skilled in the art from the above description of its structure. The latter embodiment operates without shoulder supports.

What is claimed is:

1. A mobile track tamping, leveling and lining machine for correcting the position of a track and comprising (a) a tool carrier mounted on the machine for movement along, and on, the track rails, (b) lifting and lining drive means for vertically and laterally moving the tool carrier, (c) track engaging tool means mounted on the carrier and comprising only two track rail engaging and exiting rollers for each track rail, the rollers being arranged on opposite sides of the rail and having a circumferential configuration conforming to the side faces and undersides of the head of the rail on the opposite sides thereof, (d) a pivoting arm connected to each one of the track rail engaging rollers and independently pivotal on the tool carrier about a respective vertical axis for pivoting the rollers in a plane substantially parallel to the track, and (e) drive means connected to each one of the pivoting arms for driving the rollers into force-transmitting engagement with the conforming side face and underside of a respective one of the track rails.

2. The mobile track tamping, leveling and lining machine of claim 1, wherein each one of the track rail engaging rollers has a radially projecting collar at a lower portion of the roller for engaging a structural element of the rail arranged in the range of the vertical rail web.

3. The mobile track tamping, leveling and lining machine of claim 1 or 2, wherein the tool carrier extends substantially centrally between the two rollers associated with each track rail, each one of the vertical axes, the pivotal arms and track rail engaging rollers associated with one of the track rails being arranged mirror-symmetrically with respect to the arms and rollers associated with the other track rail.

4. The mobile track tamping, leveling and lining machine of claim 1, wherein each one of the track rail engaging rollers is a rotary body having an eccentric axis of rotation substantially parallel to the vertical pivoting axis, the distance between the axes corresponding at least to half a width of the rail head.

5. The mobile track tamping, leveling and lining machine of claim 1, wherein the two lifting rollers for each rail are spaced from each other in the direction of elongation of the rail.

* * * * *